United States Patent [19]

Nisi et al.

[11] Patent Number: 4,886,105

[45] Date of Patent: Dec. 12, 1989

[54] PROCESS FOR CURING SAND MOLDINGS

[75] Inventors: Dieter Nisi, Grossheppach; Helmut Paul, Esslingen, both of Fed. Rep. of Germany

[73] Assignee: Daimler-Benz Aktiengesellschaft, Stuttgart, Fed. Rep. of Germany

[21] Appl. No.: 264,867

[22] Filed: Oct. 31, 1988

[30] Foreign Application Priority Data

Oct. 30, 1987 [DE] Fed. Rep. of Germany ..... 3736775

[51] Int. Cl.[4] ..... B22C 9/12

[52] U.S. Cl. ..... 164/16; 164/5

[58] Field of Search ..... 164/5, 16

[56] References Cited

U.S. PATENT DOCUMENTS 4,553,983 11/1985 Baker ..... 55/16

FOREIGN PATENT DOCUMENTS 2550588 7/1976 Fed. Rep. of Germany . . .

2621153 11/1977 Fed. Rep. of Germany ..... 164/16

*Primary Examiner*—Richard K. Seidel

[57] ABSTRACT

A process is described for curing sand moldings, in particular casting cores, by the cold box process. In this process a catalyst containing gas mixture escaping from the mold is passed over a mixture feed side of a semipermeable membrane while a pressure is maintained on the permeate side of the membrane which is less than the pressure on the mixture feed side, whereby the catalyst vapors preferentially permeate through the membrane, and a permeate carrier gas stream which is, in particular, 50 to 300 liters greater than the permeate stream passing through the membrane per $m^2$ and per hour is passed over the permeate side of the membrane. The catalyst, in particular a tertiary amine, is greatly concentrated in the permeate carrier gas stream and can simply and inexpensively be removed from the latter by condensation. Inexpensive, virtually complete recovery of the expensive catalyst is possible using the process.

4 Claims, 1 Drawing Sheet

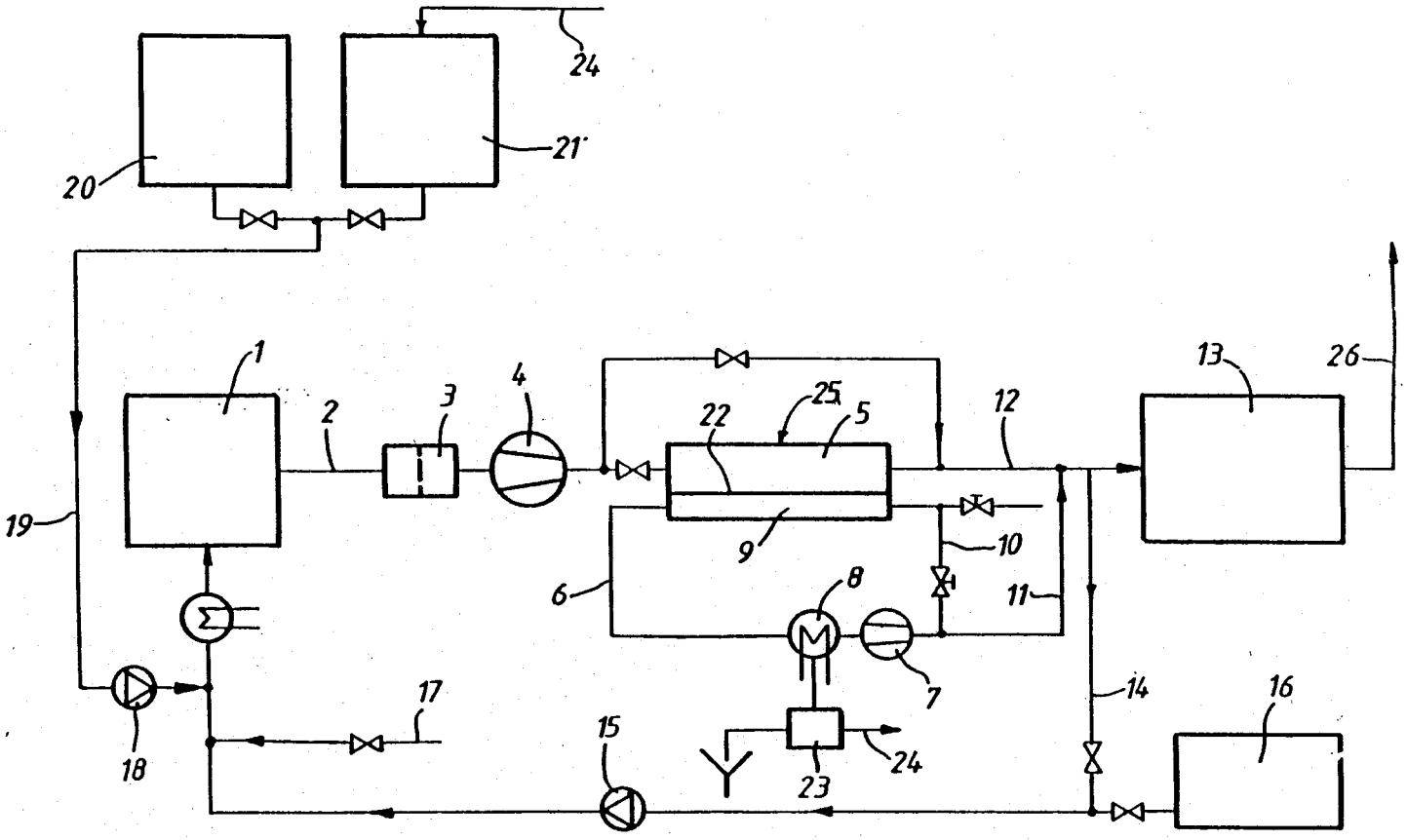
26
13
16
14
12
11
10
7
24
5
25
8
23
22
9
15
6
24
21
4
3
17
2
1
18
20
19

PROCESS FOR CURING SAND MOLDINGS

BACKGROUND AND SUMMARY OF THE INVENTION

The invention relates to a process for curing sand moldings, in particular casting cores, made from synthetic resin-bound sand by means of gas or vapor form catalyst which is added to a carrier gas, after which the catalyst/carrier gas mixture is forced through the mold containing the loose sand molding, the gas mixture escaping from the mold being collected as completely as possible without mixing with atmospheric air, and the catalyst component of the gas mixture being removed from the latter as completely as possible by condensation and, where appropriate, being re-used after removal of contaminants.

The process outlined in the introduction is described in detail in German Pat. No. 2,550,588. Using this so-called cold box process, cores having good flexural strength and abrasion resistance, high dimensional accuracy and surface quality and a long shelf life can be produced from cold molds in very short cycle times. The sand mixture for this process comprises dry quartz sand and a liquid two-component synthetic resin binder system which cures on introduction of the catalyst.

The catalysts used are highly volatile amines which are liquid at room temperature, most frequently triethylamine, dimethylethylamine or dimethylisopropylamine.

Since the amines are evil smelling and toxic, they must not be allowed to reach the environment. In addition to removal of the amines from the offgas stream of a core producing plant by acid washing, thermal afterburning or cumbustion in a cupola furnace after introduction into the hot blast stream, with the amines being lost has been contemplated. It is known from German Pat. No. 2,550,588 to remove the catalyst and other condensable vapors from the catalyst containing offgas by condensation. The catalyst can be re-used, if necessary after removal of contaminants, for example by fractional distillation.

A general disadvantage of this process is that the catalyst is only present in a relatively low concentration in the carrier gas mixture. In order to remove the catalyst, considerable cooling of the entire gas stream is therefore necessary, which is associated with high costs. The process has therefore not been able to establish itself in industry, even in spite of the high price of the catalyst.

An object of the invention is therefore to make it possible to recover the catalyst more inexpensively in a process for curing sand moldings. This object is achieved in a process wherein the gas mixture escaping from the mold is passed over the mixture feed side of a semipermeable membrane while a pressure is maintained on the permeate side of the membrane which is lower than the pressure on the mixture feed side, whereby the catalyst vapors preferentially permeate through the membrane, and a permeate carrier gas stream which is greater than the permeate stream passing through the membrane is passed over the permeate side of the membrane, and wherein the catalyst vapors are recovered from the permeate carrier gas stream.

An important aspect of the invention is thus that the catalyst/carrier gas mixture escaping from the mold is no longer condensed directly, but instead that, after permeation through a semipermeable membrane, a catalyst concentrated gas mixture is produced from which the catalyst can then be recovered at lower cost, for example by condensation. For this purpose, the gas mixture escaping from the mold is passed over the mixture feed side of a semipermeable membrane which preferentially allows the catalyst components of the gas mixture to pass through (permeate). A membrane of this type which is suitable in the present process comprises, for example, polydimethylsiloxane.

The driving force for permeation of the catalyst is formed by a partial pressure gradient between the mixture feed side of the membrane and the reverse side, the so-called permeate side. This concentration gradient is established by maintaining a lower pressure on the permeate side of the membrane than prevails on the mixture feed side. In addition, the partial pressure gradient on the permeate side is further increased by passing over the permeate side of the membrane a permeate carrier gas stream which is greater than the permeate stream permeating through the membrane. A permeate carrier gas stream which is about 50 to 200 (liter) greater than the permeate volume passing through the membrane per $m^2$ ($meter^2$) and per hour is preferred. The carrier gas used is air or nitrogen. Nitrogen is therefore preferred since explosive mixtures cannot arise together with the catalyst vapors permeating. On the permeate side, a gas mixture which is highly concentrated with respect to the catalyst content is present, from which the condensable components can be removed in a manner known per se by cooling. A purification step, for example fractional distillation, may be necessary before re-use of the catalyst. The separation of substance mixtures using membranes is known in principle, for example from U.S. Pat. No. 4,553,983, in which the recovery of solvents, in particular from paint shops, is described. Surprisingly, the principles described therein on permeation can also be applied according to the invention to permeation of the highly polar, basic amines used as catalyst in mold production, although paint solvents are neutral and essentially nonpolar.

Other objects, advantages and novel features of the present invention will become apparent from the following detailed description of the invention when considered in conjunction with the accompanying drawings.

BRIEF DESCRIPTION OF THE DRAWINGS

The single drawing FIGURE schematically depicts a process for curing sand moldings according to preferred embodiments of the invention.

DETAILED DESCRIPTION OF THE INVENTION

The catalyst containing gas mixture escaping from the molds of a core shooter 1 passes through line 2 into filter 3, in which the gas mixture is separated from mechanical impurities, such as sand, dust and the like. Using a fan 4, the gas mixture is then passed over a mixture feed side 5 of a membrane module 25. A large number of separating membranes are disposed in a very tight space in a separating module of this type. The module used can be a tubular, plate, coil or capillary system.

The arrangement of the separating membrane in modules has the purpose of accommodating the greatest possible membrane surface area in the tightest or smallest possible space. For reasons of simplicity, however, only a single membrane is shown in the drawing. In order to achieve the best possible separation action between the carrier gas mixture was the catalyst, the permeability of the membrane should be as high as possible to the catalyst and as low as possible to the carrier gas mixture. In order to achieve the highest possible flow of the catalyst vapors through the membrane, the latter must be as thin as possible. Since the mechanical stability of thin membranes decreases greatly, it is usual to dispose the membrane on a support. Suitable supports are, for example, microporous films, as are also used in ultra-filtration. A suitable membrane material which makes possible good separation between the carrier gas and the catalyst is, for example, polydimethylsiloxane.

The catalyst depleted gas mixture leaves the separation module 25 through line 12 and is fed back to the core shooter 1 via line 14 with the aid of a compressor 15. If necessary, nitrogen from tank 16 or compressed air through line 17 can be added to the gas stream. Fresh catalyst is introduced from tanks 20 or 21 into the gas stream via line 19 with the aid of the pump 18.

A temperature control unit 22 can be used to bring the catalyst containing gas stream to its optimum temperature. If not all the gas stream emerging from the membrane separation module 25 through line 12 is to be recycled, the excess can be discharged via line 26, if necessary after treatment 13 (for example acid scrubbing).

The catalyst permeating through the membrane 22 on the permeate side 9 of the membrane separation module is removed by suction via line 6 with the aid of a vacuum pump 7 and freed from condensable components in a condenser 8. The depleted gas stream subsequently passes back to the permeate side 9 of the membrane separation module 25 via line 10.

A pressure of about 0.2–98% preferably between 0.2–20%, of the pressure on the gas feed side 5 is maintained on the permeate side 9 of the separation module. In order to accelerate removal of the catalyst from the permeate side of the membrane, a permeate carrier gas stream which is greater than the permeate stream permeating through the membrane is passed over the permeate side 9. Since small amounts of carrier gas constantly pass through the membrane into the permeate circuit, this excess is passed through line 11 into line 12, which contains the depleted catalyst/carrier gas mixture. The temperature of the condenser 8 is expediently set so that as few contaminants, such as water or other solvents, as possible are co-condensed, and a high catalyst quality is thus produced. It may be necessary to separate by distillation in a separation plant 23 the condensate removed in the condenser. In any case, the recovered catalyst is fed back into the catalyst storage tank 21 through line 24, which is only shown in part. If the temperature of the condenser 8 is set so that as few contaminants as possible, in particular water, are produced during the condensation, concentration of the contaminants in the permeate side circuit should not be feared since the content of contaminants in the permeate side circuit always remains relatively low due to removal of excess carrier gas through line 11.

If it is not intended to recycle the catalyst depleted gas mixture emerging from the membrane separation module 25 through line 12 into the core shooter 1 through line 14 with the aid of the compressor 15, nitrogen from tank 16 or compressor air from line 17 can also be used as the carrier gas.

The relatively expensive catalyst can be recovered virtually completely in a simple and inexpensive manner using the process.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Process for curing sand moldings, in particular casting cores, made from synthetic resin-bound sand by means of gas- or vapor-formed catalyst which is added to a carrier gas, after which the catalyst/carrier mixture is forced through the mold containing the loose sand molding, the gas mixture escaping from the mold being collected as completely as possible without mixing with atmospheric air, and the catalyst component of the gas mixture being removed from the latter as completely as possible by condensation and, where appropriate, being re-used after removal of contaminants, wherein the gas mixture escaping from the mold is passed over the mixture feed side of a semipermeable membrane while a pressure is maintained on the permeate side of the membrane which is lower than the pressure on the mixture feed side, whereby the catalyst vapors preferentially permeate through the membrane, and a permeate carrier gas stream which is greater than the permeate stream passing through the membrane is passed over the permeate side of the membrane, and wherein the catalyst vapors are recovered from the permeate carrier gas stream.

2. Process according to claim 1, wherein the permeate carrier gas stream is 50 to 300 liters greater than the permeate stream passing through the membrane per square meter per hour.

3. Process according to claim 1, wherein the pressure of the carrier gas stream is 0.2 to 20% of the pressure of the gas stream on the mixture feed side.

4. Process according to claim 2, wherein the pressure of the carrier gas stream is 0.2 to 20% of the pressure of the gas stream on the mixture feed side.

* * * * *